US012714191B2

(12) United States Patent
Caldwell et al.

(10) Patent No.: US 12,714,191 B2
(45) Date of Patent: Aug. 25, 2026

(54) SOLE STRUCTURE FOR ARTICLE OF FOOTWEAR

(71) Applicant: NIKE, Inc., Beaverton, OR (US)

(72) Inventors: Cailee M. Caldwell, Beaverton, OR (US); Yuchung K. Chen, Portland, OR (US); Gregory Scott, Portland, OR (US); Dolores S. Thompson, Beaverton, OR (US); Nikita A. Troufanov, Portland, OR (US); Jeremy W. Webber, Portland, OR (US); Jay T. Worobets, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 250 days.

(21) Appl. No.: 18/049,864

(22) Filed: Oct. 26, 2022

(65) Prior Publication Data

US 2023/0137398 A1 May 4, 2023

Related U.S. Application Data

(60) Provisional application No. 63/272,861, filed on Oct. 28, 2021.

(51) Int. Cl.
*A43B 13/18* (2006.01)
*A43B 13/12* (2006.01)

(52) U.S. Cl.
CPC ..... *A43B 13/188* (2013.01); *A43B 13/122* (2013.01); *A43B 13/125* (2013.01)

(58) Field of Classification Search
CPC ... A43B 13/127; A43B 13/125; A43B 13/026; A43B 13/12; A43B 13/122; A43B 13/16;
(Continued)

(56) References Cited

U.S. PATENT DOCUMENTS 380,507 A * 4/1888 Munger ..... A43B 21/37 36/36 R
4,594,798 A * 6/1986 Autry ..... A43B 23/17 36/114

(Continued)

FOREIGN PATENT DOCUMENTS

FR 2851892 A1 * 9/2004 ..... A43B 7/088
KR 101006923 B1 1/2011

(Continued)

OTHER PUBLICATIONS

Translation of LU-85167-A1 (Year: 1985).*

(Continued)

*Primary Examiner* — Grady Alexander Nunnery
(74) *Attorney, Agent, or Firm* — Honigman LLP; Matthew H. Szalach

(57) ABSTRACT

A sole structure for an article of footwear includes an upper cushioning element including a first material having a first durometer, a lower cushioning element including a second material having a second durometer and defining a plurality of first engagement elements, and a plate disposed between the upper cushioning element and the lower cushioning element, the plate including a plurality of second engagement elements cooperating with the first engagement elements to position the plate with respect to the lower cushioning element.

18 Claims, 10 Drawing Sheets

(58) Field of Classification Search
CPC ..... A43B 13/141; A43B 7/142; A43B 3/0031; A43B 7/24; A43B 13/183; A43B 13/184; A43B 13/185; A43B 13/181; A43B 23/22; A43B 21/26
USPC ..... 36/107
See application file for complete search history.

(56) References Cited

U.S. PATENT DOCUMENTS 4,598,487 A * 7/1986 Misevich ..... A43B 13/187 36/129
4,922,631 A * 5/1990 Anderie ..... A43B 13/16 36/76 R
5,665,785 A * 9/1997 McClellan ..... B60C 7/00 521/145
2003/0172548 A1* 9/2003 Fuerst ..... A43B 13/026 36/28
2007/0028484 A1* 2/2007 Akhidime ..... A43B 13/181 36/76 R
2007/0068046 A1* 3/2007 Mathieu ..... A43C 15/09 36/102
2009/0049716 A1* 2/2009 Romero ..... A43B 7/08 36/3 R
2009/0320330 A1* 12/2009 Borel ..... A43B 13/14 36/30 R
2011/0162232 A1* 7/2011 Gazzara ..... A43B 13/12 36/28
2013/0091739 A1* 4/2013 Yang ..... A43B 13/12 36/30 R
2014/0026443 A1* 1/2014 Derrier ..... A43B 13/026 36/107
2014/0082969 A1* 3/2014 Binzer ..... A43C 15/161 36/107
2014/0137430 A1* 5/2014 Cherosky ..... A43B 7/12 36/7.1 R
2014/0305005 A1* 10/2014 Yeh ..... A43B 7/144 36/69
2015/0250260 A1* 9/2015 Bessho ..... A43B 7/18 36/25 R
2017/0095034 A1* 4/2017 Dupre ..... A43B 13/12
2018/0237605 A1* 8/2018 Chang ..... C08G 18/3284
2018/0343965 A1* 12/2018 Mitchell ..... B32B 7/12
2020/0229541 A1* 7/2020 Berberian ..... A43B 13/36
2021/0204651 A1 7/2021 Thompson et al.
2022/0061454 A1* 3/2022 Nakaya ..... A43B 13/127
2022/0192320 A1* 6/2022 Ho ..... A43B 17/14

FOREIGN PATENT DOCUMENTS

KR 20120134550 A * 12/2012 ..... A43B 13/182
LU 85167 A1 * 9/1985 ..... A43B 13/36
WO WO-2022076857 A1 4/2022

OTHER PUBLICATIONS

Translation of KR-20120134550-A (Year: 2012).*
Translation of FR-2851892-A1 (Year: 2004).*
European Patent Office (ISA), International Search Report and Written Opinion for PCT App. No. PCT/US2022/078757, mailed Feb. 17, 2023.

* cited by examiner

SOLE STRUCTURE FOR ARTICLE OF FOOTWEAR

CROSS REFERENCE TO RELATED APPLICATIONS

This application claims priority under 35 U.S.C. § 119(e) to U.S. Provisional Application No. 63/272,861, filed on Oct. 28, 2021. The disclosure of this prior application is considered part of the disclosure of this application and is hereby incorporated by reference in its entirety.

FIELD

The present disclosure relates generally to sole structures for articles of footwear, and more particularly, to sole structures having a composite structure.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper defines an opening to receive a foot. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
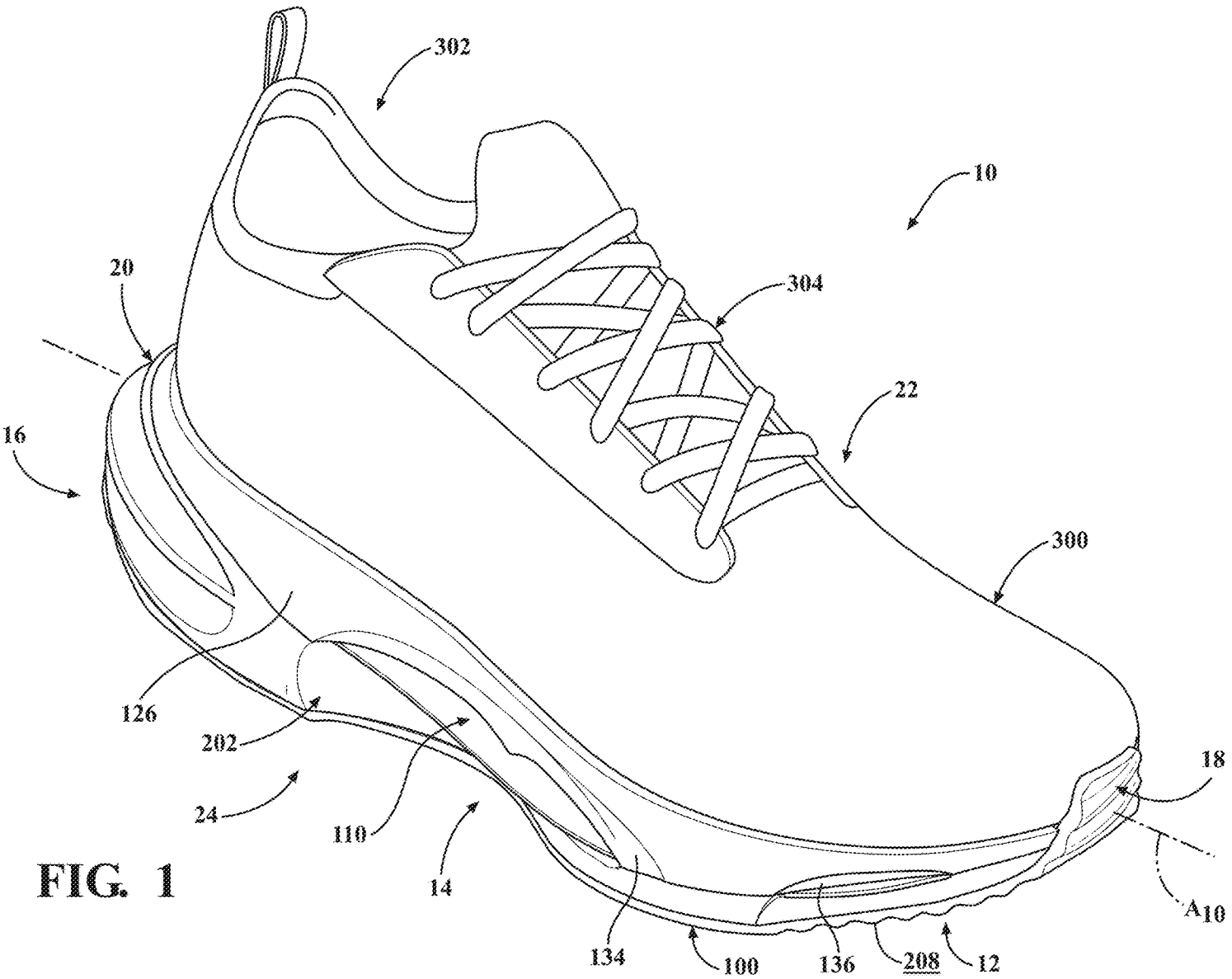
FIG. 1 is a perspective view of an article of footwear including a sole structure in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear includes an upper cushioning element including a first material having a first durometer, a lower cushioning element including a second material having a second durometer and defining a plurality of first engagement elements, and a plate disposed between the upper cushioning element and the lower cushioning element, the plate including a plurality of second engagement elements cooperating with the first engagement elements to position the plate with respect to the lower cushioning element.

The sole structure may include one or more of the following optional features. For example, the first durometer may be less than the second durometer. Additionally or alternatively, the second engagement elements may be integrally formed with the plate.

In one configuration, the plate may be disposed within a socket formed in a first surface of the lower cushioning element. Further, the plate may be exposed along a periphery of the sole structure between adjacent ones of the first engagement elements.

An outsole may define a ground engaging element formed of a third material. In this configuration, the ground engaging element may be disposed adjacent to the lower cushioning element.

In one configuration, the plate may be formed of an elastomeric material. Additionally or alternatively, the first material may be a first foamed elastomer and the second material may be a second foamed elastomer.

An insole may be positioned above the upper cushioning element.

The lower cushioning element may define a thickness between a top surface and a bottom surface. The thickness of the lower cushioning element may be non-uniform.

In another configuration, a sole structure for an article of footwear includes a first cushioning element defining a first peripheral side surface, a second cushioning element attached to the first cushioning element and defining a second peripheral side surface aligned with the first peripheral side surface, and a plate disposed between the first cushioning element and the second cushioning element and including a first portion that extends from the first peripheral side surface and the second peripheral side surface.

The sole structure may include one or more of the following optional features. For example, the second cushioning element may include a plurality of openings formed through a thickness of the second cushioning element. In this configuration, a bottom surface of the plate may be exposed through each of the openings.

In one configuration, the first portion of the plate may extend from the first peripheral side surface and the second peripheral side surface at a mid-foot region of the sole structure. Additionally or alternatively, the first portion of the plate may extend from the first peripheral side surface and the second peripheral side surface at one of a medial side of the sole structure and a lateral side of the sole structure.

At least one of the first cushioning element and the second cushioning element may include a recess that receives the plate. Additionally or alternatively, at least one of the first cushioning element and the second cushioning element may include at least one engagement element operable to receive an engagement element of the plate to position the plate relative to the at least one of the first cushioning element and the second cushioning element.

In one configuration, the plate may include a second portion that extends from the first peripheral side surface and the second peripheral side surface. In this configuration, the second portion may be spaced apart and separated from the first portion by an expanse of at least one of the first cushioning element and the second cushioning element.

The first cushioning element may include a first material having a first durometer and the second cushioning element may include a second material having a second durometer different than the first durometer.

The second cushioning element may include a heel counter. The heel counter may at least partially surround the plate.

The details of one or more implementations of the disclosure are set forth in the accompanying drawings and the description below. Other aspects, features, and advantages will be apparent from the description and drawings, and from the claims.

Figure 8:
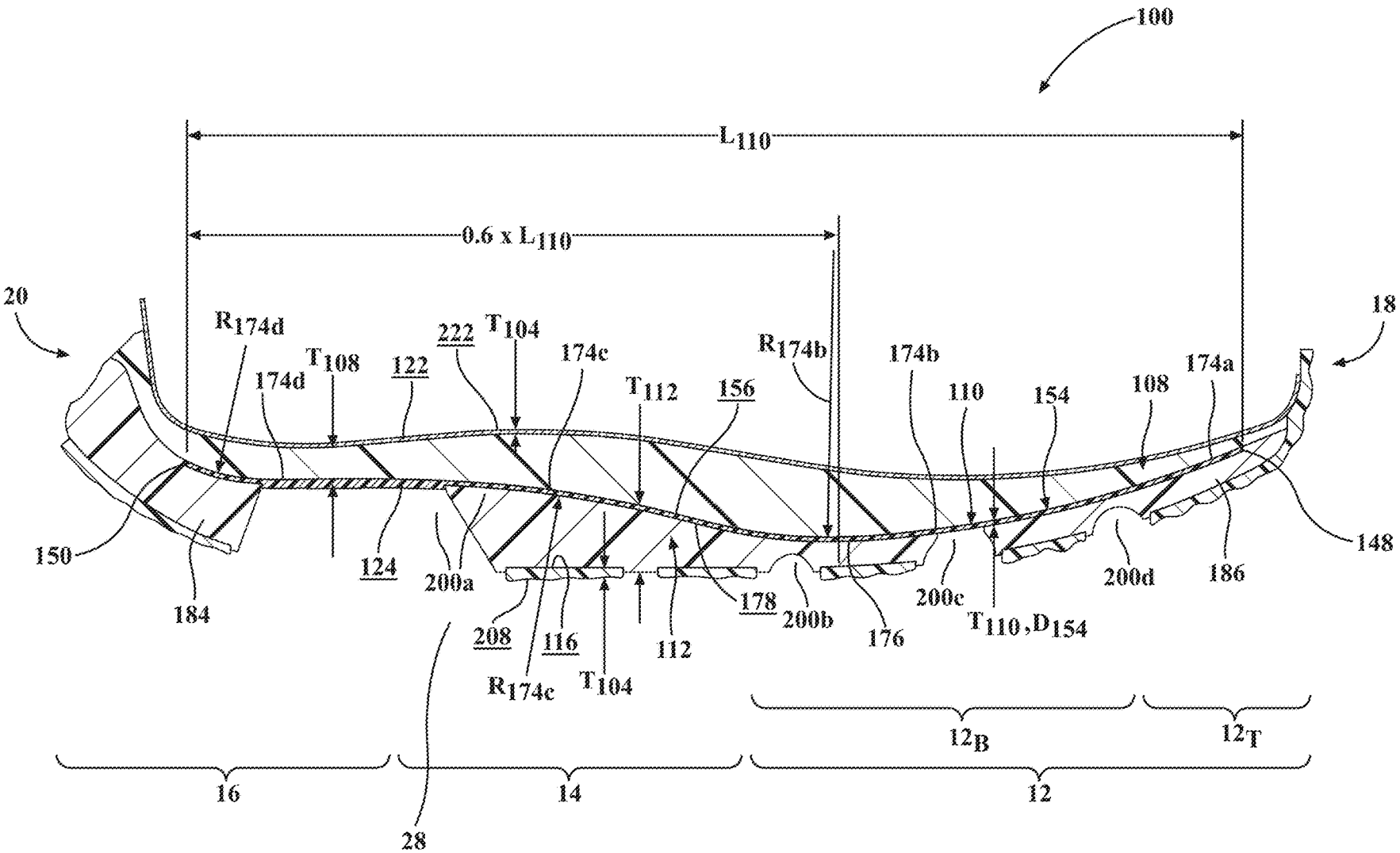
FIG. 8 is a cross-sectional view of the sole structure of FIG. 7, taken along Line 8-8 of FIG. 7.
Figure 9:
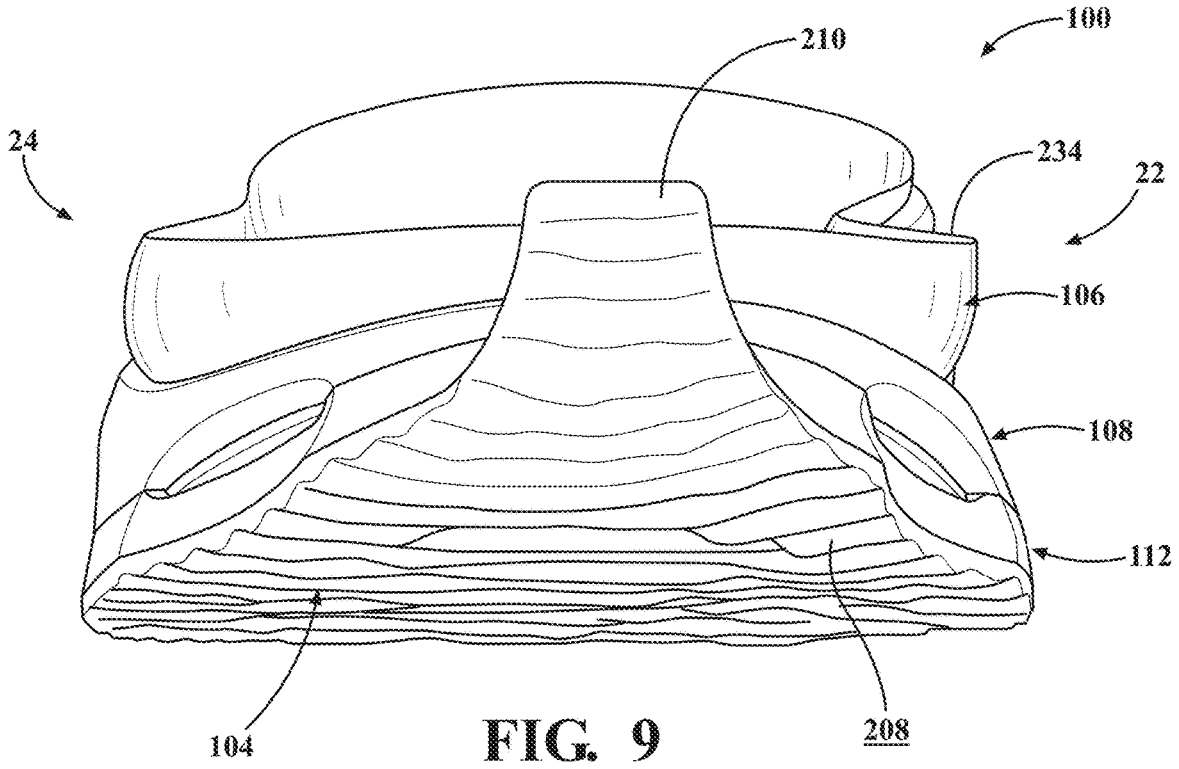
FIG. 9 is a forward elevation view of the sole structure of FIG. 6.
Figure 10:
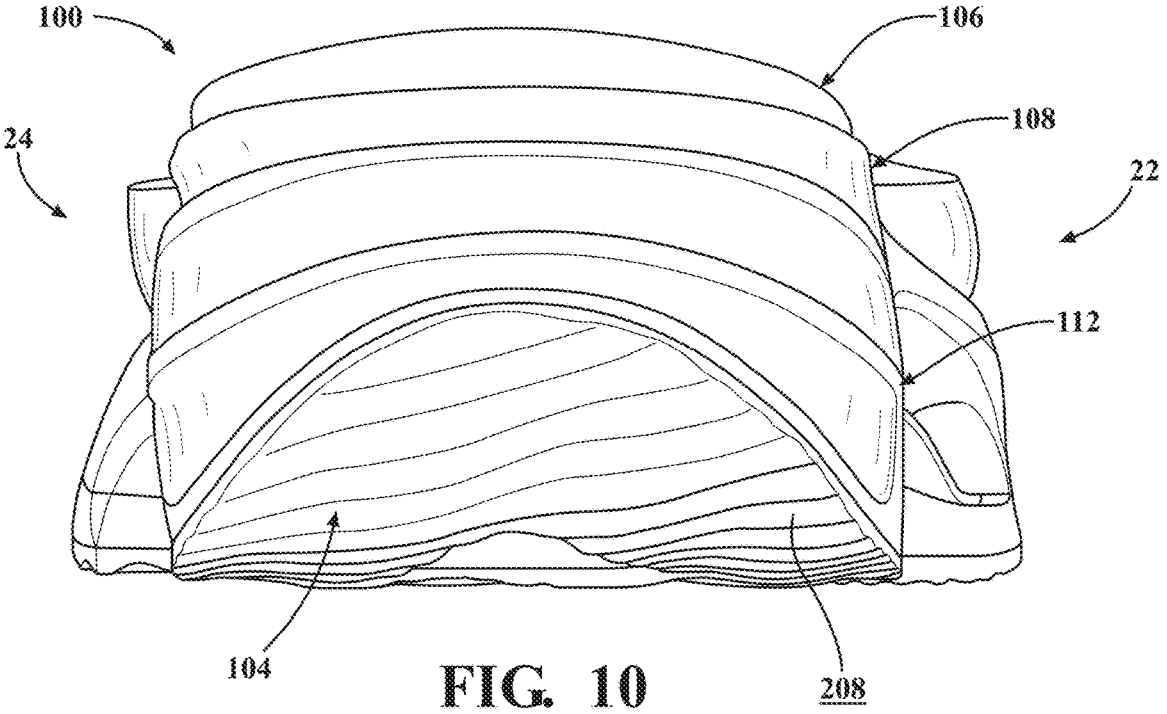
FIG. 10 is a rear elevation view of the sole structure of FIG. 6.
Figure 11:
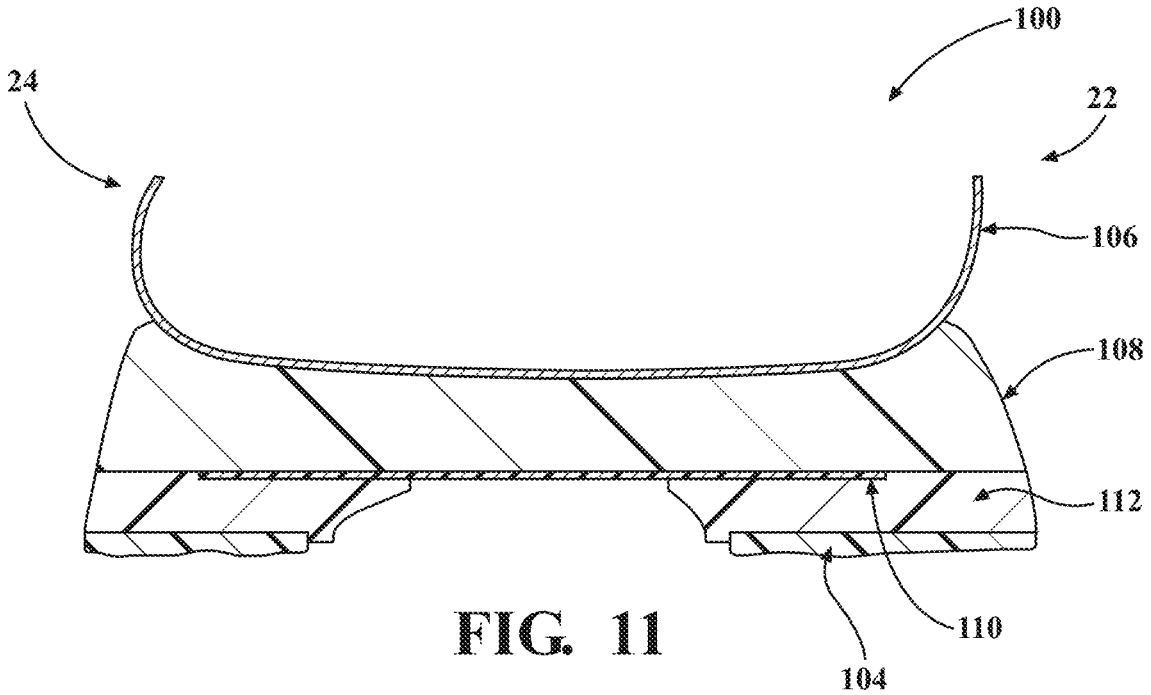
FIG. 11 is cross-sectional view of the sole structure of FIG. 6, taken along Line 11-11 of FIG. 7.
Figure 12:
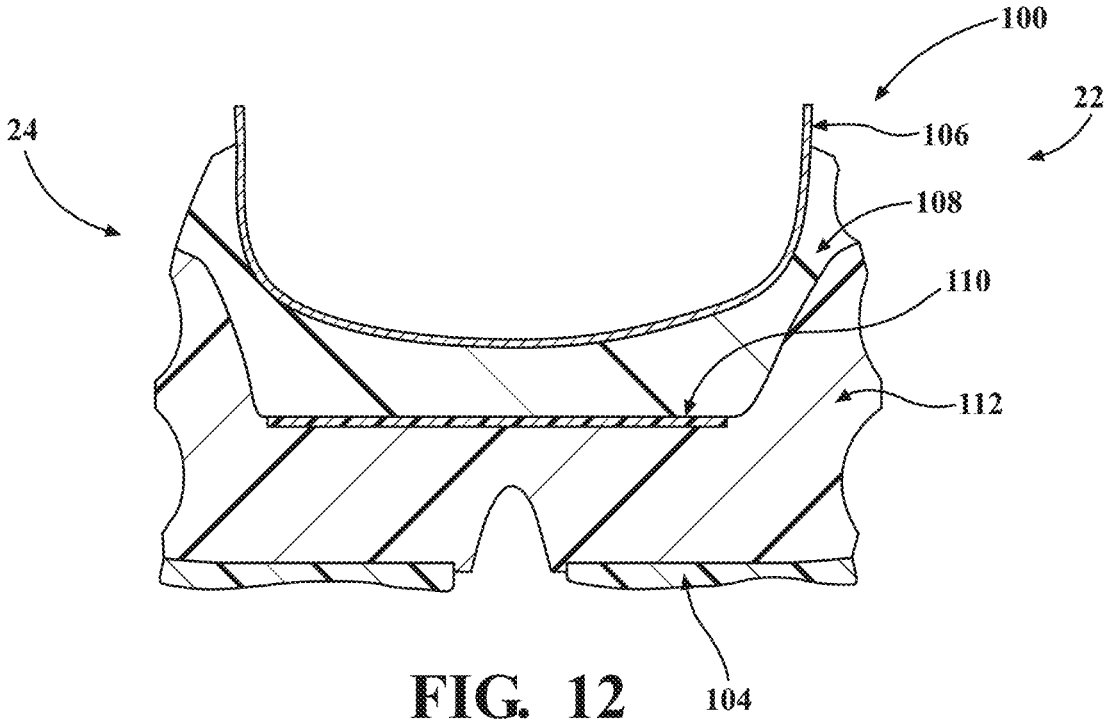
FIG. 12 is a cross-sectional view of the sole structure of FIG. 6, taken along Line 12-12 of FIG. 7.

Referring to FIG. 1, an article of footwear 10 includes a sole structure 100 and an upper 300 attached to the sole structure 100. The article of footwear 10, the sole structure 100, and the upper 300 may be divided into one or more regions. The regions may include a forefoot region 12, a mid-foot region 14, and a heel region 16. As indicated in FIG. 8, the forefoot region 12 may be described as including a toe portion $\mathbf{12}_T$ corresponding with the phalanges of the foot and a ball portion $\mathbf{12}_B$ corresponding to the metatarsophalangeal (MTP) joint of the foot. The mid-foot region 14 may correspond with an arch area of the foot, and the heel region 16 may correspond with rear portions of the foot, including a calcaneus bone. The footwear 10, the sole structure 100, and the upper 300 may further include an anterior end 18 associated with a forward-most point of the forefoot region 12, and a posterior end 20 corresponding to a rearward-most point of the heel region 16. A longitudinal axis $A_{10}$ of the footwear 10 extends along a length of the footwear 10 from the anterior end 18 to the posterior end 20, and generally divides the footwear 10 into a medial side 22 and a lateral side 24, as shown in FIG. 1. Accordingly, the medial side 22 and the lateral side 24 respectively correspond with opposite sides of the footwear 10 and extend through the regions 12, 14, 16. The upper 300 may include different shapes and/or geometries, but typically includes an opening 302 that receives a foot and one or more fastening elements, such as laces 304.

Figure 2:
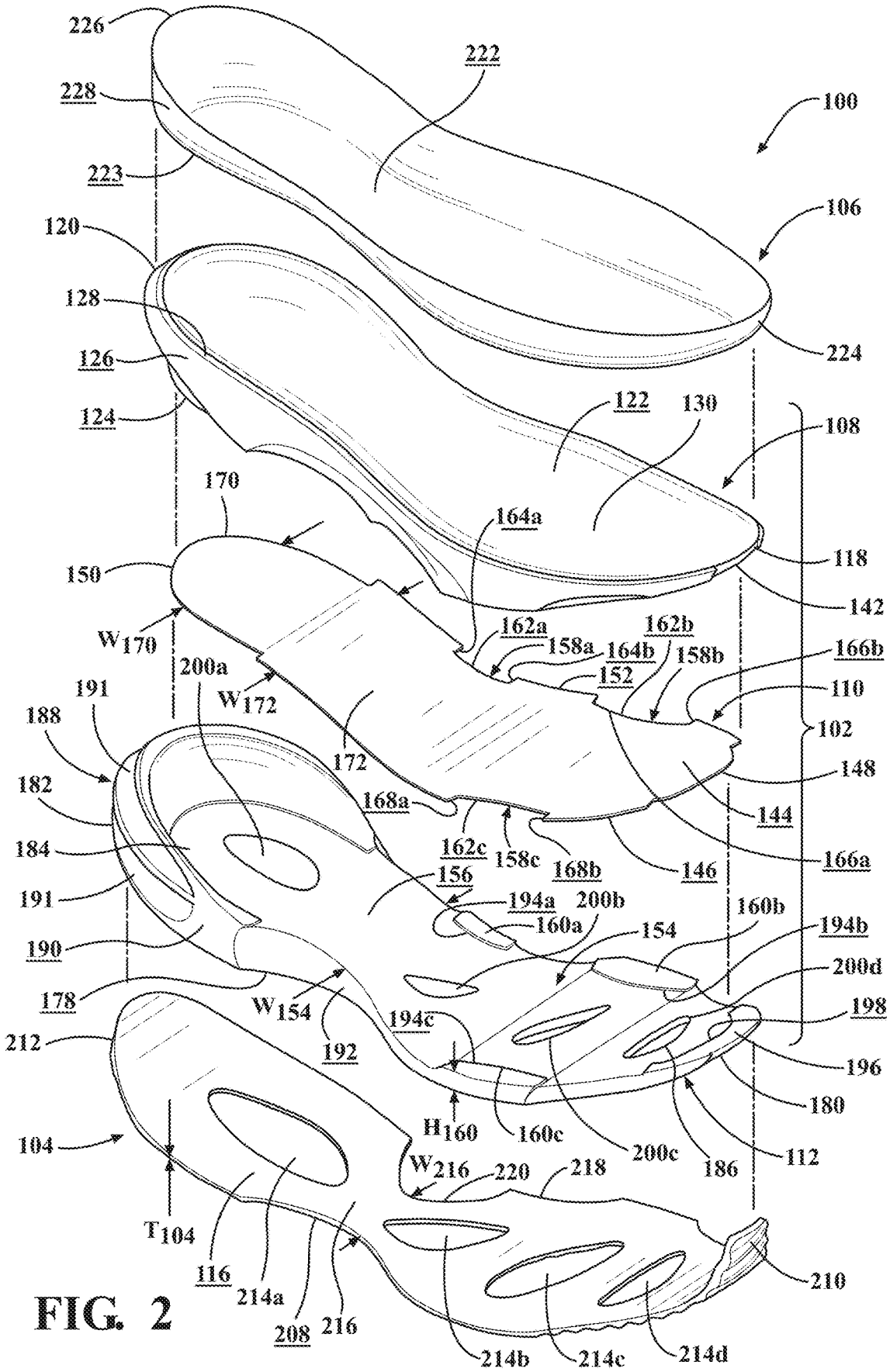
FIG. 2 is an exploded top perspective view of a sole structure in accordance with the principles of the present disclosure, for use with the article of footwear of FIG. 1.

With reference to FIG. 2, the sole structure 100 includes a midsole 102 configured to provide cushioning and performance characteristics to the sole structure 100, an outsole 104 configured to provide a ground-engaging surface of the article of footwear 10, and in insole 106 configured to provide cushioning to the sole structure 100. Unlike conventional sole structures, the midsole 102 of the sole structure 100 may be formed compositely and include a plurality of subcomponents for providing desired forms of cushioning and support throughout the sole structure 100. For example, the midsole 102 includes an upper cushioning element 108, a support plate 110, and a lower cushioning element 112. The midsole 102 is disposed between the insole 106 and the outsole 104. The outsole 104 includes a top surface 116 configured to be disposed against a portion of the midsole 102.

With reference to FIGS. 2-4 and 7, the upper cushioning element 108 extends longitudinally from a first end 118 at the anterior end 18 to a second end 120 at the posterior end 20. The upper cushioning element 108 includes a top surface 122, a bottom surface 124 formed on an opposite side of the upper cushioning element 108 than the top surface 122, and a peripheral side surface 126. In one exemplary arrangement, the peripheral side surface 126 extends from the bottom surface 124 to a top edge 128 that at least partially extends above the top surface 122 of the upper cushioning element 108, thereby defining a socket 130. The peripheral side surface 126 defines an outer periphery of the upper cushioning element 108. Referring to FIG. 8, a distance from the top surface 122 to the bottom surface 124 defines a thickness $T_{108}$ of the upper cushioning element 108. In some examples, the thickness $T_{108}$ varies along the longitudinal axis $A_{10}$. For example, the thickness $T_{108}$ is thicker in mid-foot region 14 than in the forefoot region 12 and the heel region 16.

Figure 3:
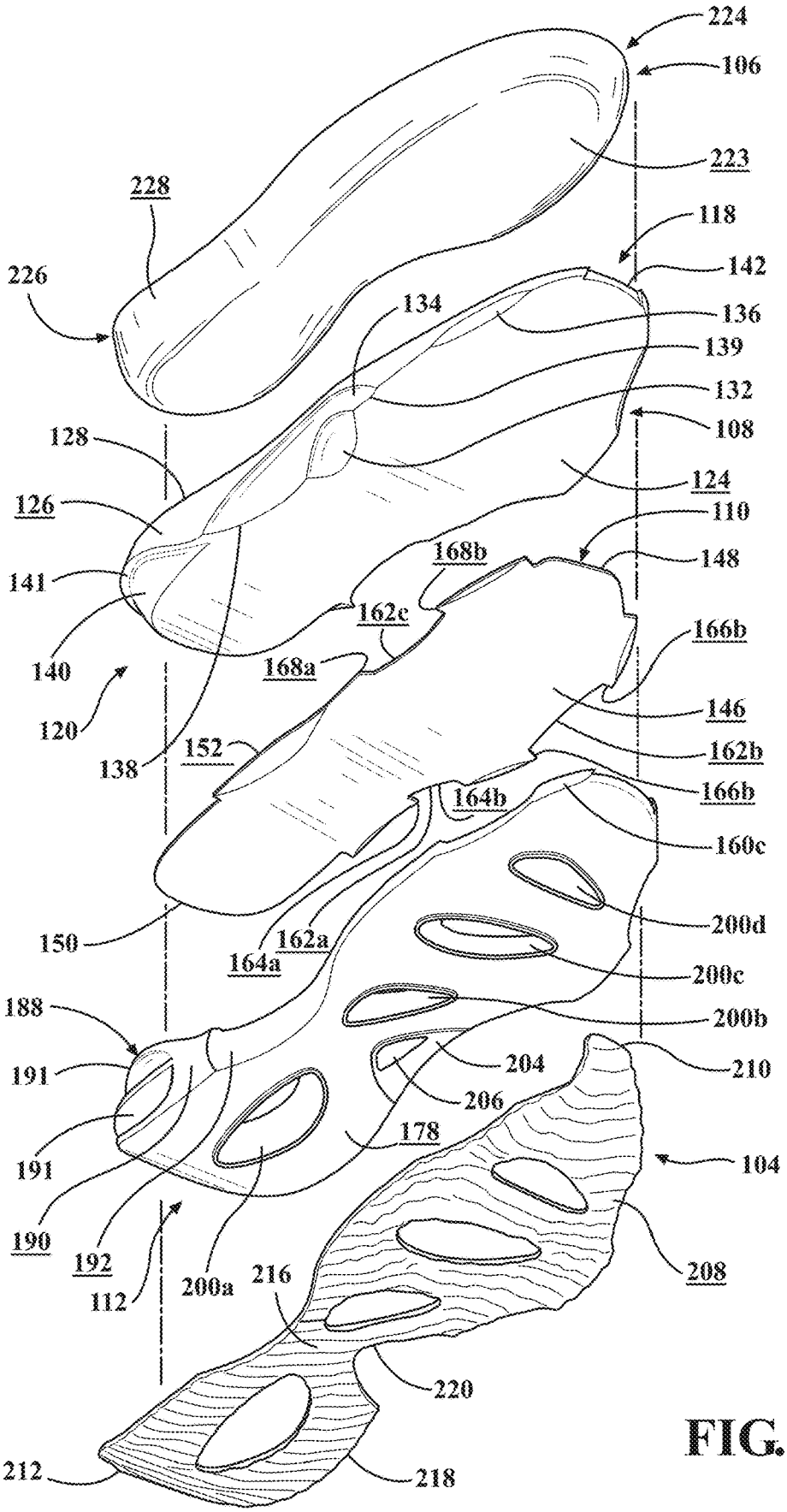
FIG. 3 is an exploded bottom perspective view of a sole structure in accordance with the principles of the present disclosure, for use with the article of footwear of FIG. 1.

In some examples, as best shown in FIG. 3, the peripheral side surface 126 may include one or more lateral cutout sections 132, 134, 136. For example, a first lateral cutout section 132 may be provided on the lateral side 24 of peripheral side surface 126, extending upwardly from the bottom surface 124 and inwardly from the peripheral side surface 126. A second lateral cutout section 134 extends upwardly from the bottom surface 124 in an arcuate shape adjacent the heel region 16 from a first end 138 toward the forefoot region 12 at a second end 139. The second cutout section 134 may have a thickness that is variable, in that the second cutout section 134 extends further inwardly adjacent the first end 138 than the second end 139. The third lateral cutout section 136 is positioned adjacent the forefoot region 12 and extends upwardly from the bottom surface 124 and inwardly from the peripheral side surface 126 toward the interior of the upper cushioning element 108.

While examples of the lateral cutout sections 132, 134, 136 have been illustrated, it is understood that the present disclosure is not limited to those configurations. Other configurations of lateral cutout sections 132, 134, 136 are contemplated as being part of the present disclosure. While not shown, it is also understood that the medial side of the peripheral side surface 126 may include one or more cutouts (not shown). In some arrangements, the cutouts on the medial side 22 of the peripheral side surface 126 may mirror the cutout sections 132, 134, 136 on the lateral side 24. Alternatively, the cutout sections 132, 134, 136 on the medial side 22 may be different than the arrangements of cutouts on the lateral side 24. As yet a further exemplary arrangement, the peripheral side surface 126 may not include any cutout sections on either the lateral side 24 or the medial side 22, or the cutout sections may be provided on only one of the lateral side 24 or medial side 22 of the peripheral side surface 126.

As best shown in FIG. 3, the second end 120 of the upper cushioning element 108 further includes a recessed portion 140 that extends from the bottom surface 124 upwardly to a portion of the peripheral side surface 126 that extends around the second end 120. The recessed portion 140 defines an engagement lip 141, as described in further detail below. The engagement lip 141 extends around the second end 120 from the lateral side 24 of the peripheral side surface 126 to the medial side 22 of the peripheral side surface 126. The first end 118 of the upper cushioning element 108 may further include a recess 142 formed therein. The recess 142 extends from a bottom surface 124 to the top surface 122.

Figure 7:
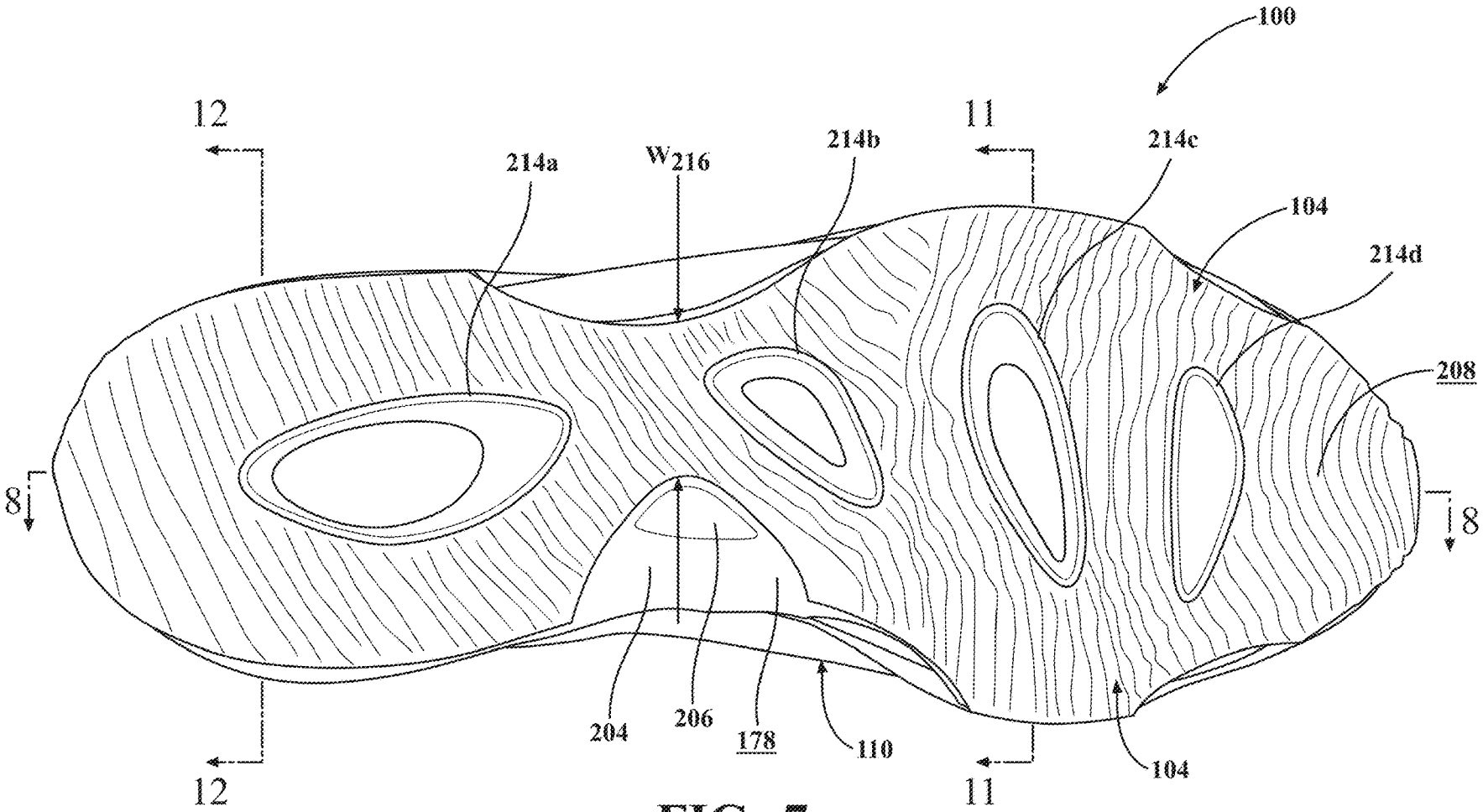
FIG. 7 is a bottom plan view of a forefoot cushioning element in accordance with the principles of the present disclosure, for use with the sole structure of FIG. 6.

Referring to FIGS. 2-3, the support plate 110 is shown. The support plate 110 is defined by a top surface 144 and a bottom surface 146 formed on an opposite side of the support plate 110 than the top surface 144. In one example, the support plate 110 extends from a first end 148 at the anterior end 18 of the sole structure 100 to a second end 150 at the posterior end 20 of the sole structure 100. However, in one exemplary arrangement, the support plate 110 may only include a forefoot region so as to provide rigidity to the sole structure to inhibit flexion in the forefoot region. Additional length of the support plate 110 may be used for bonding the support plate 110 to the upper cushioning element 108 and lower cushioning element 112. A peripheral side surface 152 extends from the top surface 144 to the bottom surface 146 and defines a peripheral profile of the support plate 110. A distance from the top surface 144 to the bottom surface 146 defines a thickness $T_{110}$ of the support plate 110. In one illustrated example, as shown in FIG. 7, the thickness $T_{110}$ of the support plate 110 is substantially constant. The support plate 110 includes one or more rigid or semi-rigid materials having a greater durometer than any of the cushioning elements 108, 112. In some examples, the plate 110 includes an elastomeric material, such as nylon. Additionally or alternatively, the plate 110 may include one or more composite materials.

As shown in FIGS. 2 and 8, when the sole structure 100 is assembled, the support plate 110 is disposed within a socket 154 of the lower cushioning element 112 and is interposed between the upper cushioning element 108 and the lower cushioning element 112. As shown, the thickness $T_{110}$ of the support plate 110 is the same as a depth $D_{154}$ of the socket 154, such that the top surface 144 of the support plate 110 is flush with a top surface 156 of the lower cushioning element 112 when the sole structure 100 is assembled. Accordingly, when the sole structure 100 is assembled, the top surface 144 of the support plate 110 and the top surface 156 of the lower cushioning element 112 form a continuous surface upon which the bottom surface 124 of the upper cushioning element 108 rests.

With reference to FIG. 2, the support plate 110 may include one or more engagement elements 158*a*, 158*b*, 158*c*. Engagement elements 158*a*, 158*b*, 158*c* are sized to cooperate with mating engagement elements 160*a*, 160*b*, 160*c* formed on the lower cushioning element 112, as will be discussed below in greater detail. In the illustrated example, the engagement elements 158*a*, 158*b*, 158*c* are formed as recesses that extends inwardly from the peripheral side surface 152 to define inner edge surfaces 162*a*, 162*b*, 162*c*. Edge surface 162*a* is flanked by side edge surfaces 164*a*, 164*b*, edge surface 162*b* is flanked by side edge surfaces 166*a*, 166*b*, and edge surface 162*c* is flanked by side edge surfaces 168*a*, 168*b*.

The support plate 110 includes a heel portion 170 that has a width $W_{170}$ that is less than a width $W_{172}$ of a mid-foot portion 172. As will be explained below, the increased width of the mid-foot portion 172 permits a portion of the support plate 110 to extend outwardly from the cutout sections 132, 134, and 136 of the peripheral side surface 126 of the upper cushioning element 108, as shown in FIG. 1. This configuration allows the support plate 110 to provide greater support to the plantar surface of the foot along the lateral and medial sides 22 and 24, while maximizing flexibility of the sole structure 100 through the mid-foot region 14.

With continued reference to FIG. 8, the support plate 110 includes a compound curvature extending from the first end 148 to the second end 150, and may be described as including different portions 174*a*-174*d* each having a different curvature. Particularly, the support plate 110 includes a toe portion 174*a*, a ball portion 174*b*, a mid-foot portion 174*c*, and a heel portion 174*d*, which are respectively disposed in the corresponding regions $12_T$, $12_B$, 14, 16. As shown, the toe portion 174*a* extends from the first end 148 of the support plate 110 and is substantially straight. Each of the ball portion 174*b* and the heel portion 174*d* form concave portions of the support plate 110 where the top surface 144 has a concave curvature. The mid-foot portion 174*c* forms a portion of the support plate 110 where the top surface 144 has a convex curvature. Accordingly, the top surface 144 of the support plate 110 is cupped in the forefoot region 12 and the heel region 16, and forms an inverted (i.e., convex) transition region between the ball portion 174*b* and the heel portion 174*d*.

Referring still to FIG. 8, the ball portion 174*b* of the support plate 110 is configured to support the metatarsophalangeal (MTP) joint of the foot. As shown, the ball portion 174*b* forms a concave potion of the top surface 144 having a radius $R_{174b}$ of curvature between the toe portion 174*a* and the mid-foot portion 174*c*. The ball portion 174*b* further includes a lower vertex 176 located at the lowermost point of the ball portion 174*b*. In one example, as shown in FIG. 7, the lower vertex 176 is positioned approximately 60% of the length $L_{110}$ of the support plate 110 from the second end 150 of the support plate 110.

As provided above, each of the mid-foot portion 174*c* and the heel portion 174*d* are also curved to accommodate curvature of the plantar surface of the foot. For example, the mid-foot portion 174*c* of the plate 110 curves along a second radius of curvature $R_{174c}$ that is less than the first radius of curvature $R_{174b}$ of the ball portion 174*b*, and forms a convex portion of the top surface 144. The heel portion 174*d* of the plate 110 curves along a third radius curvature $R_{174d}$ that is less than the first radius of curvature $R_{174b}$ of the ball portion 174*b*, and forms a concave portion of the top surface 144.

Referring to FIGS. 2-3, details of the lower cushioning element 112 will now be described. As discussed above, the lower cushioning element 112 includes the top surface 156 that defines the socket 154 into which the support plate 110 is disposed. A bottom surface 178 is formed on an opposite side of the lower cushioning element 112 than the top surface 156. The lower cushioning element 112 extends from a first end 180 at the anterior end 18 of the sole structure 100 to a second end 182 at the posterior end 20 of the sole structure 100. A thickness $T_{112}$ of the lower cushioning element 112 is defined by the top and bottom surfaces 156 and 178, respectively. In some examples, as shown in FIG. 8, the thickness $T_{112}$ varies between a heel portion 184 and a forefoot portion 186.

The lower cushioning element 112 may be constructed as a composite structure including a heel counter 188 that is attached to the socket 154. The heel counter 188 extends around the posterior end 20 of the article of footwear 10, and is configured to provide stability around the heel region 16. Accordingly, the heel counter 188 may be formed of a material having a greater hardness than the material that defines the socket 154. The heel counter 188 extends upwardly from the top surface 156 of the lower cushioning element 112. A peripheral side surface 190 is defined by the heel counter 188 at the heel portion 184. In one exemplary arrangement, the peripheral side surface 190 may be provided with one or more grooved surfaces 191 to reduce weight and improve flexibility of the heel counter 188. It is understood that other configurations of the peripheral side surface 190 are contemplated within this disclosure.

The socket 154 is defined by a peripheral side surface 192. The peripheral side surface 192 of the socket 154 is positioned inwardly with respect to the peripheral side surface 190 of the heel counter 188. The lower cushioning element 112 includes the mating engagement elements 160*a*, 160*b*, 160*c* that cooperate with the engagement elements 158*a*, 158*b*, 158*c*, respectively to secure the support plate 110 within the socket 154. The engagement element members 160*a*, 160*b*, 160*c*, are raised elements positioned on the peripheral side surface of 192 of the lower cushioning element 112. The engagement element members 160*a*, 160*b*, 160*c* define a height $H_{160}$ that is greater than the thickness $T_{112}$ of the lower cushioning element 112 at the locations where the engagement element members 160*a*, 160*b*, 160*c* are disposed. With this configuration, each of the engagement element members 160*a*, 160*b*, 160*c* define respective bearing surfaces 194*a*, 194*b*, 194*c* against which the respective inner edge surfaces 162*a*, 162*b*, 162*c* engage when the support plate 110 is disposed within the socket 154.

In one example, the lower cushioning element 112 may include a forward engagement element 196 that defines an inner bearing surface 198. The first end 148 of the support plate 110 engages the inner bearing surface 198 when the support plate 110 is engaged in the socket 154. The lower cushioning element 112 may further be provided with one or more openings 200*a*, 200*b*, 200*c*, 200*d* that extend between the top surface 156 and the bottom surface 178. The openings 200*a*, 200*b*, 200*c*, 200*d* may be configured with a variety of different shapes. The openings 200*a*, 200*b*, 200*c*, 200*d* serve to reduce the material used in constructing the footwear 10 and, as such, the overall weight of the footwear 10.

The peripheral side surface 192 on the lateral side 24 of the lower cushioning element 112 may be contoured inwardly such that the width $W_{154}$ of the socket 154 narrows at a portion that corresponds to the position of the lateral arch of the foot. With this arrangement, when the lower cushioning element 112 is assembled to the upper cushioning element 108, the cutout 134 may mate with the contoured lateral side 192 to define a continuous groove 202 on the lateral side 24 of the lower cushioning element 112, with a portion of the support plate 110 bisecting the groove 202, as shown best in FIGS. 1 and 6. In this manner, the support plate 110 provides support to the plantar surface of the foot along the lateral side 24, but also allows flexibility of the sole structure through the mid-foot region, as well as the forefoot region.

Referring to FIGS. 3 and 7, the bottom surface 178 of the lower cushioning element 112 is shown. The bottom surface 178 may further include a recessed portion 204 that extends upwardly from the bottom surface 178 and into a portion of the thickness $T_{112}$ of the lower cushioning element 112, adjacent the medial side 22 of the lower cushioning element 112. In a further example, another recess 206 may be disposed within the recessed portion 204 to further reduce the weight of the footwear 10.

Referring to FIGS. 2 and 3, the outsole 104 will now be described. As discussed above, the outsole 104 includes the top surface 116. A bottom surface 208 is formed on an opposite side of the outsole 104 than the top surface 116. The outsole 104 extends from a first end 210 at the anterior end 18 of the sole structure 100 to a second end 212 at the posterior end 20 of the sole structure 100. A thickness $T_{104}$ of the outsole 104 is defined by the top and bottom surfaces 116 and 208, respectively. In one example, as shown in FIG. 8, the thickness $T_{104}$ is substantially constant between the first end 210 and the second end 212. Additionally, the first end 210 is configured to curve upwardly above the top surface 116. The bottom surface 208 is a ground-engaging element and forms a ground-engaging surface 208 of the article of footwear 10. The ground-engaging surface 208 may be textured with alternating ridges and grooves, as shown in FIG. 3. Alternatively, the ground-engaging surface 208 may be provided with other geometric shapes, to provide a textured surface.

The outsole 104 may also be provided with one or more openings 214*a*, 214*b*, 214*c*, 214*d* that extend through the outsole 104. The openings 214*a*, 214*b*, 214*c*, 214*d* are positioned to generally correspond to the position of openings 200*a*, 200*b*, 200*c*, 200*d* formed in the lower cushioning element 112. In one exemplary arrangement, the openings 214*a*, 214*b*, 214*c*, 214*d* are sized to be slightly larger than the openings 200*a*, 200*b*, 200*c*, 200*d*.

The outsole 104 may further comprise a necked portion 216 extending through the mid-foot region 14. The necked portion 216 is a portion of the outsole 104 in the mid-foot region 14 having a reduced width $W_{216}$ relative to the adjacent portions of the outsole 104 in the forefoot region 12 and heel region 16. As shown in FIGS. 2 and 3, the necked portion 216 is formed where a portion of a peripheral side surface 218 along the medial side 22 is inwardly offset towards the interior of the outsole 104 (i.e., the longitudinal axis $A_{10}$) and forms a recess 220 along the medial side 22 of the outsole 104. A longitudinal position of the necked portion 216 corresponds to the position of the lateral arch of the foot, while a longitudinal position of the recess 220 corresponds to the position of the medial arch of the foot. In other words, the outsole 104 is absent in a portion of the sole structure 100 corresponding to the medial arch of the foot.

Referring to FIGS. 2 and 3, details of the insole 106 will now be described. The insole 106 includes a top surface 222 and a bottom surface 223 that is formed on an opposite side of the insole 106 than the top surface 222. The top surface 222 is configured to form a footbed of the sole structure 100. The insole 106 extends from a first end 224 at the anterior end 18 of the sole structure 100 to a second end 226 at the posterior end 20 of the sole structure 100. A thickness $T_{106}$ of the insole 106 is defined by the top and bottom surfaces 222 and 223, respectively. In some examples, as shown in FIG. 8, the thickness $T_{106}$ is substantially constant between the first end 224 and the second end 226. A peripheral side surface 228 extends upwardly from the top surface 222 of the insole 106 and defines an outer periphery of the insole 106.

The insole 106, the upper cushioning element 108, and the lower cushioning element 112 include resilient polymeric materials, such as foam or rubber, to impart properties of cushioning, responsiveness, and energy distribution to the foot of the wearer. In the illustrated example, the upper cushioning element 108 includes a first foam material, and the lower cushioning element 112 includes a second foam material. The support plate 110 is formed of a rigid material that is more firm (i.e., rigid) than the first and second foam materials of the upper cushioning element 108 and the lower cushioning element 112 so as to restrict flexion in the forefoot. This will save energy in the foot and minimize foot fatigue. The insole 106 may include a third foam material. For example, the upper cushioning element 108 may include a first foamed material having a first durometer and the lower cushioning element 112 may include a second foamed material having a second durometer. In one exemplary arrangement, the first durometer is less than the second durometer so as to provide a cushioning effect for the wearer in the upper cushioning element 108. The durometer of the third foam material may be less than the second durometer. In one exemplary arrangement, the durometer of the third foam material is also less than the first durometer.

The insole 106, the upper cushioning element 108, the support plate 110, and the lower cushioning element 112, may be affixed to each other using a fusing process, using an adhesive, or by suspending the elements in a different resilient polymeric material. Alternatively, the plurality of elements may not be affixed to each other, but may remain independent. As discussed above, the cushioning elements 106, 108, and 112 may be formed with cooperating geometries (e.g., steps, protrusions) for restricting relative motion between the components 106, 108, 110, 112 of the sole structure 100.

Example resilient polymeric materials for the cushioning elements 106, 108, 112 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Figure 4:
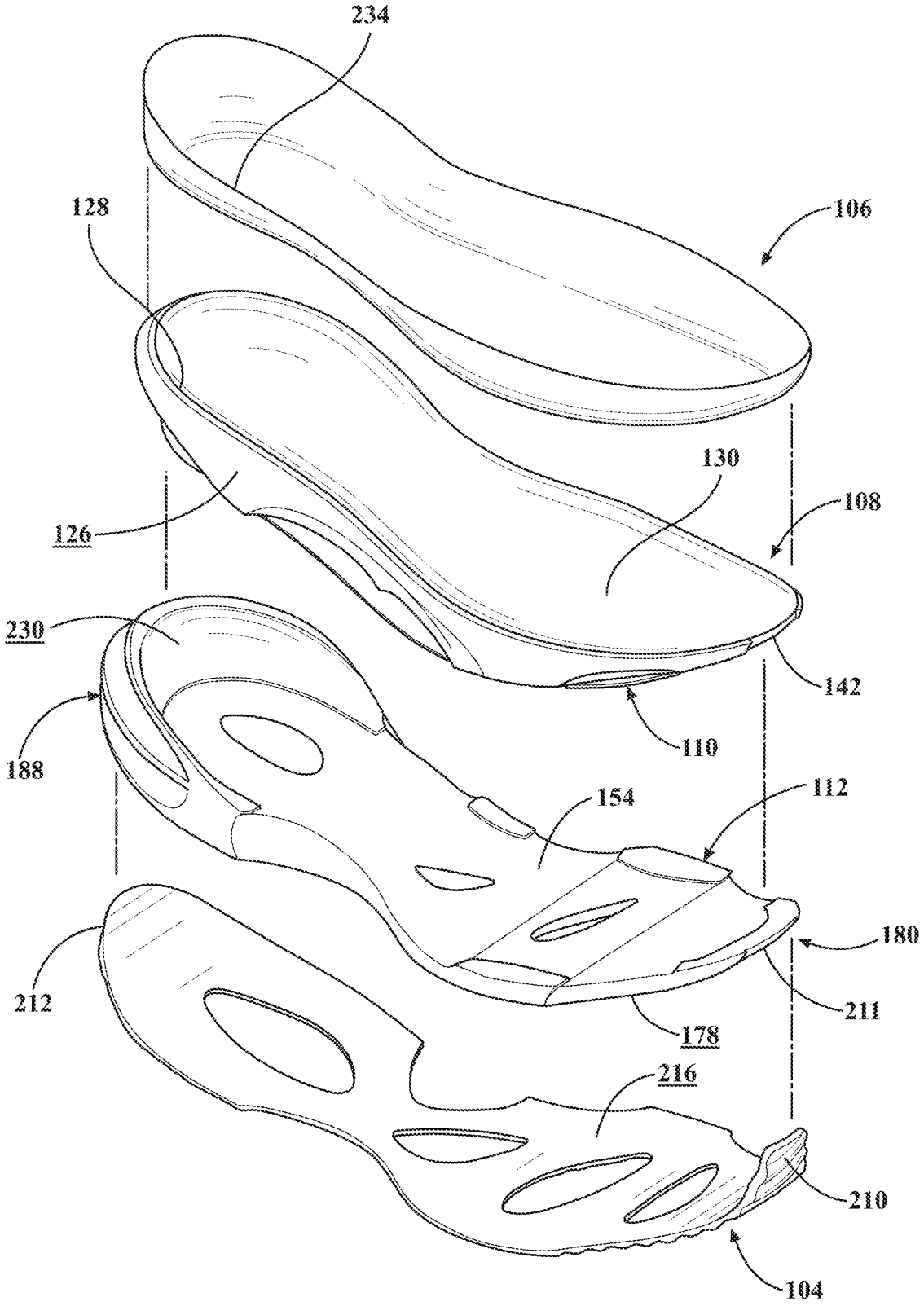
FIG. 4 is a partially exploded top perspective view of a sole structure in accordance with the principles of the present disclosure, for use with the article of footwear of FIG. 1.

With continued reference to FIGS. 2-9, assembly of the sole structure 100 will be described. In the illustrated example, the upper cushioning element 108 is secured to the support plate 110. More specifically, the bottom surface 124 of the upper cushioning element 108 is secured to the top surface 144 of the support plate 110, as shown in FIG. 4 by any of the methods disclosed above. Alternatively, the support plate 110 may be first disposed within the socket 154 of the lower cushioning element 112. In either method, the engagement elements 158*a*, 158*b*, 158*c* of the support plate 110 engage with the mating engagement elements 160*a*, 160*b*, 160*c* of the lower cushioning element 112 such that the inner edge surfaces 162*a*, 162*b*, and 162*c* engage against the bearing surfaces 194*a*, 194*b*, 194*c* of the engagement elements 160*a*, 160*b*, 160*c*. The heel portion 170 is positioned within the area of the lower cushioning element 112 bounded by the heel counter 188.

Due to the contoured peripheral side surface 192 extending inwardly, the peripheral edge 152 of the support plate 110 extends outwardly from the peripheral side surface 192. As such, at least one of the top surface 144 and the bottom surface 146 of the support plate 110 may extend from and be exposed at the contoured peripheral side surface 192. For example, the peripheral edge 152 of the support plate 110 may include a first portion that extends from the peripheral side surface 192 at the mid-foot region 14 at one or both of the medial side 22 and the lateral side 24. Further, the support plate 110 may include a second portion that extends from the midsole 102 and is spaced apart and separated from the first portion. See, for example, the exposed portion of the support plate 110 at cutout sections 132, 134, 136.

Regardless of whether the support plate 110 extends from the midsole 102, in one exemplary arrangement, the first end 148 of the support plate 110 may engage against the bearing surface 198 of the forward engagement element 196. Thus, the support plate 110 becomes frictionally locked within the socket 154 to fix a position of the support plate 110 relative to the lower cushioning element 112.

Figure 5:
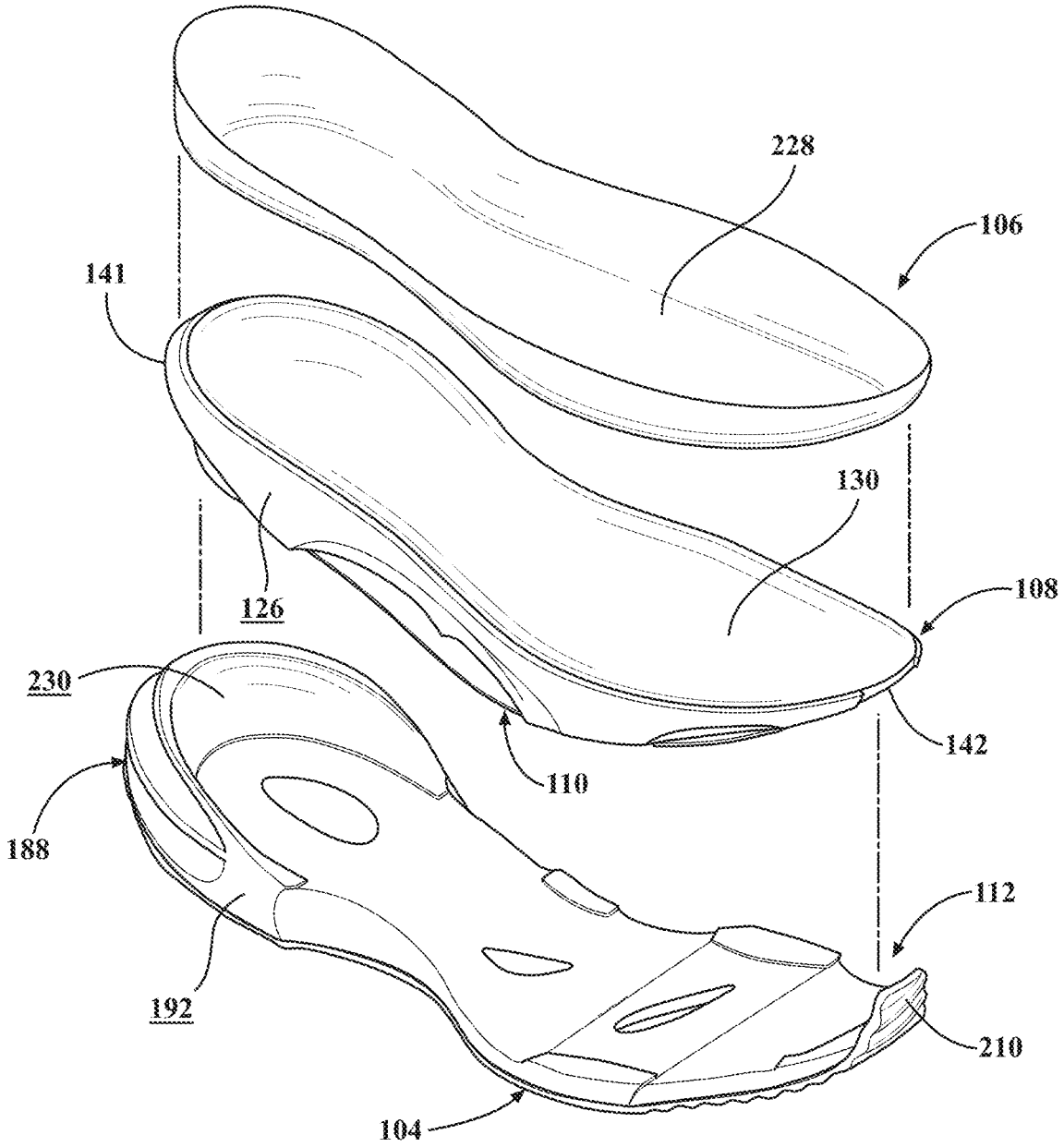
FIG. 5 is a partially exploded top perspective view of a sole structure in accordance with the principles of the present disclosure, for use with the article of footwear of FIG. 1.

Referring to FIG. 5, the outsole 104 is secured to the lower cushioning element 112. More specifically, the top surface 116 of the outsole 104 is secured to the bottom surface 178 of the lower cushioning element 112 by any of the methods discussed above. The first end 210 of the outsole 104 extends upwardly above the top surface 156 of the lower cushioning element 112 when the outsole 104 is secured to the lower cushioning element 112. The first end 180 of the lower cushioning element 112 may include a recess 211 into which the first end 210 of the outsole 104 is disposed.

Still referring to FIG. 5, with the support plate 110 being positioned between the lower cushioning element 112 and the upper cushioning element 108, the upper cushioning element 108 is engaged with the socket 154 of the lower cushioning element 112. When so engaged, the peripheral side surface 126 is disposed against an inner surface 230 of the heel counter 188. The engagement lip 141 of the upper cushioning element 108 bears against a top edge 232 of the heel counter 188. The first end 210 of the outsole 104 also extends through the recess 142 formed in the first end 118 of the upper cushioning element 108.

Figure 6:
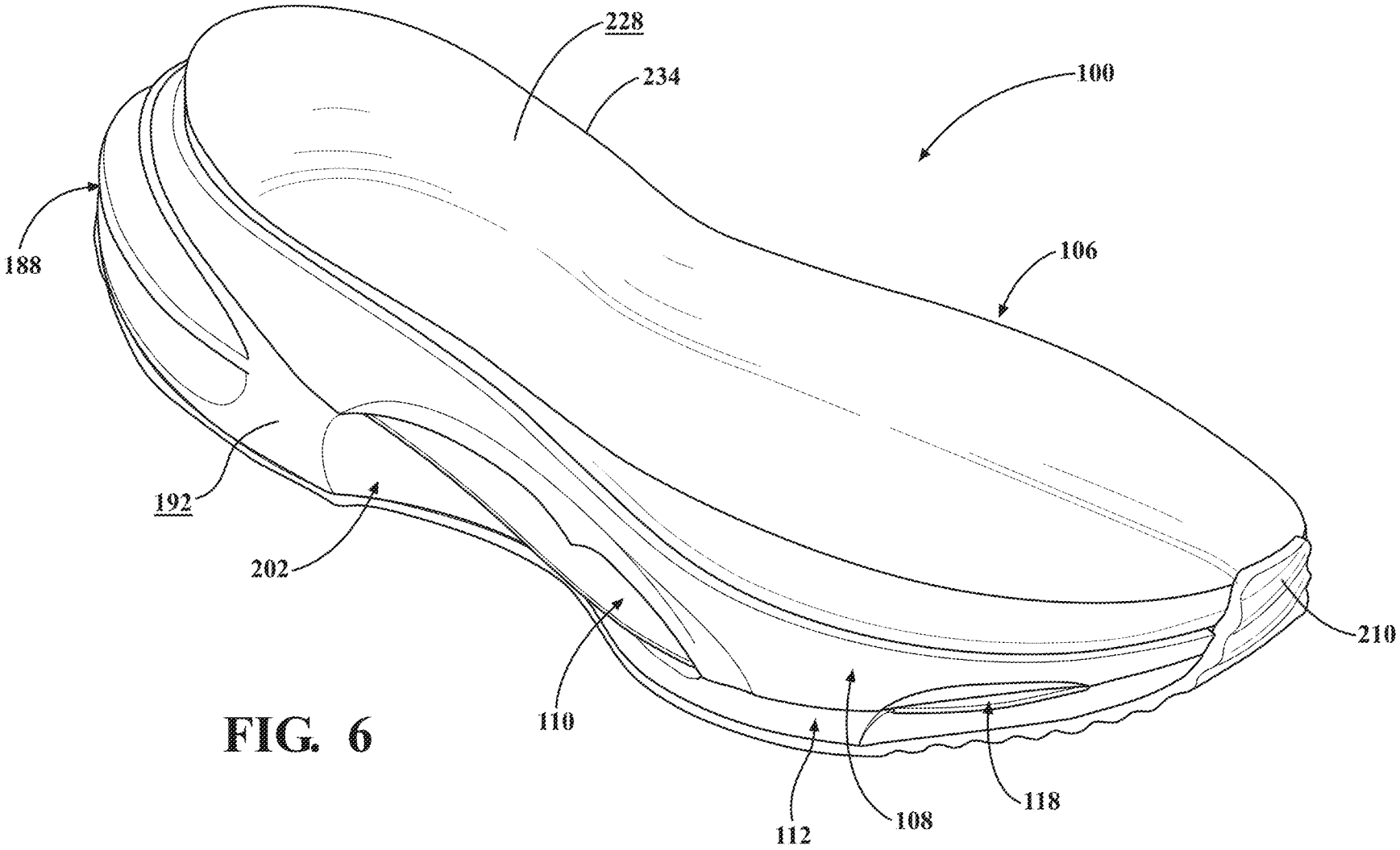
FIG. 6 is a perspective view of a sole structure in accordance with the principles of the present disclosure, for use with the article of footwear of FIG. 1.

Referring to FIG. 6, the insole 106 is disposed within and secured to the socket 130 of the upper cushioning element 108. An upper edge 234 of the insole 106 extends above the top edge 128 of the upper cushioning element 108.

With continued reference to FIG. 8, when the sole structure 100 is assembled, the midsole 102 has an overall thickness $T_{102}$ formed by the stacking of the upper cushioning element 108 (e.g., $T_{108}$), the support plate 110 (e.g., $T_{110}$), and the lower cushioning element 112 (e.g., $T_{112}$). The overall thickness $T_{102}$ is variable along the length of the midsole 102, whereby the thickness $T_{102}$ increases from the forefoot region 12 to the mid-foot region 14, and then decreases from the mid-foot region 14 to the heel region 16.

As provided above, ground-engaging surface 208 of the article of footwear 10 includes of one or more materials for imparting properties of cushioning, traction, and abrasion resistance.

As set forth above, the sole structure 100 of the present disclosure advantageously provides zonal and layered cushioning in combination with a rigid support plate. Particularly, the sole structure includes zonal cushioning by providing an upper cushioning element 108 having a first material that is softer than the second material of the lower cushioning element 112. The plate 110 restricts flexion in the forefoot area and reduces foot fatigue. This configuration provides improved impact attenuation during walking. In addition to the zonal cushioning provided by the midsole 102, the sole structure 100 includes layered cushioning by providing an insole 106 in layered arrangement with the midsole 102. Thus, the midsole 102, having first and second materials that are softer than the third material of the insole 106, provides underfoot cushioning, while the support plate 110 provides a stabilizing interface between the plantar surface of the foot and the insole 106 and midsole 102. Providing the support plate 110 between the upper cushioning element 108 and the lower cushioning element 112, particularly in the forefoot region, further increases stability within the sole structure 100, and may improve energy return while walking. Altogether, these features cooperate to provide a desirable configuration for articles of footwear associated with long periods of standing and walking.

The following Clauses provide an exemplary configuration for an article of footwear and sole structure described above.

Clause 1. A sole structure for an article of footwear, the sole structure comprising an upper cushioning element including a first material having a first durometer, a lower cushioning element including a second material having a second durometer and defining a plurality of first engagement elements, and a plate disposed between the upper cushioning element and the lower cushioning element, the plate including a plurality of second engagement elements cooperating with the first engagement elements to position the plate with respect to the lower cushioning element.

Clause 2. The sole structure of Clause 1, wherein the first durometer is less than the second durometer.

Clause 3. The sole structure of any of the preceding Clauses, wherein the second engagement elements are integrally formed with the plate.

Clause 4. The sole structure of any of the preceding Clauses, wherein the plate is disposed within a socket formed in a first surface of the lower cushioning element.

Clause 5. The sole structure of any of the preceding Clauses, wherein the plate is exposed along a periphery of the sole structure between adjacent ones of the first engagement elements.

Clause 6. The sole structure of any of the preceding Clauses, further comprising an outsole that defines a ground engaging element formed of a third material, the ground engaging element being disposed adjacent to the lower cushioning element.

Clause 7. The sole structure of any of the preceding Clauses, wherein the plate is formed of an elastomeric material.

Clause 8. The sole structure of any of the preceding Clauses, wherein the first material is a first foamed elastomer and the second material is a second foamed elastomer.

Clause 9. The sole structure of any of the preceding Clauses, further comprising an insole positioned above the upper cushioning element.

Clause 10. The sole structure of any of the preceding Clauses, wherein the lower cushioning element defines a thickness between a top surface and a bottom surface, the thickness of the lower cushioning element being non-uniform.

Clause 11. A sole structure for an article of footwear, the sole structure comprising a first cushioning element defining a first peripheral side surface, a second cushioning element attached to the first cushioning element and defining a second peripheral side surface aligned with the first peripheral side surface, and a plate disposed between the first cushioning element and the second cushioning element and including a first portion that extends from the first peripheral side surface and the second peripheral side surface.

Clause 12. The sole structure of Clause 11, wherein the second cushioning element includes a plurality of openings formed through a thickness of the second cushioning element.

Clause 13. The sole structure of Clause 12, wherein a bottom surface of the plate is exposed through each of the openings.

Clause 14. The sole structure of any of the preceding Clauses, wherein the first portion of the plate extends from the first peripheral side surface and the second peripheral side surface at a mid-foot region of the sole structure.

Clause 15. The sole structure of any of the preceding Clauses, wherein the first portion of the plate extends from the first peripheral side surface and the second peripheral side surface at one of a medial side of the sole structure and a lateral side of the sole structure.

Clause 16. The sole structure of any of the preceding Clauses, wherein at least one of the first cushioning element and the second cushioning element includes a recess that receives the plate.

Clause 17. The sole structure of any of the preceding Clauses, wherein at least one of the first cushioning element and the second cushioning element includes at least one engagement element operable to receive an engagement element of the plate to position the plate relative to the at least one of the first cushioning element and the second cushioning element.

Clause 18. The sole structure of any of the preceding Clauses, wherein the plate includes a second portion that extends from the first peripheral side surface and the second peripheral side surface, the second portion being spaced apart and separated from the first portion by an expanse of at least one of the first cushioning element and the second cushioning element.

Clause 19. The sole structure of any of the preceding Clauses, wherein the first cushioning element includes a first material having a first durometer and the second cushioning element includes a second material having a second durometer different than the first durometer.

Clause 20. The sole structure of any of the preceding Clauses, wherein the second cushioning element includes a heel counter at least partially surrounding the plate.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. A sole structure for an article of footwear, the sole structure comprising:

an upper cushioning element including a first material having a first durometer and defining a first peripheral side surface including a cutout extending inwardly from the first peripheral side surface;

a lower cushioning element attached to the upper cushioning element and including a second material having a second durometer, the lower cushioning element defining a second peripheral side surface aligned with the first peripheral side surface, including a plurality of openings formed through a thickness of the lower cushioning element, and defining a plurality of first engagement elements, the plurality of first engagement elements defining raised elements positioned proximate to the second peripheral side surface of the lower cushioning element, the cutout of the upper cushioning element mating with a contour of the lower cushioning element to define a continuous groove;

a plate disposed between the upper cushioning element and the lower cushioning element and including a first portion that extends outwardly from the first peripheral side surface and the second peripheral side surface and bisects the continuous groove, the plate defined by a top surface and an opposing bottom surface exposed through each of the plurality of openings, a distance between the top surface and the bottom surface defining a thickness of the plate, the plate including a plurality of second engagement elements formed as recesses each extending inwardly from a third peripheral side surface of the plate to define inner edge surfaces and extending through the thickness of the plate, the inner edge surfaces cooperating with the first engagement elements to position the plate with respect to the lower cushioning element; and an outsole forming a ground-contacting surface of the sole structure and including a plurality of apertures, each aperture of the plurality of apertures aligned with a respective opening in the plurality of openings and being larger than the respective opening.

2. The sole structure of claim 1, wherein the first durometer is less than the second durometer.

3. The sole structure of claim 1, wherein the second engagement elements are integrally formed with the plate.

4. The sole structure of claim 1, wherein the plate is disposed within a socket formed in a first surface of the lower cushioning element.

5. The sole structure of claim 1, wherein the plate is exposed along a periphery of the sole structure between adjacent ones of the first engagement elements.

6. The sole structure of claim 1, wherein the outsole defines a ground engaging element formed of a third material, the ground engaging element being disposed adjacent to the lower cushioning element.

7. The sole structure of claim 1, wherein the plate is formed of an elastomeric material.

8. The sole structure of claim 1, wherein the first material is a first foamed elastomer and the second material is a second foamed elastomer.

9. The sole structure of claim 1, further comprising an insole positioned above the upper cushioning element.

10. The sole structure of claim 1, wherein the thickness of the lower cushioning element is non-uniform.

11. A sole structure for an article of footwear, the sole structure comprising:

a first cushioning element defining a first peripheral side surface including a cutout extending inwardly from the first peripheral side surface;

a second cushioning element attached to the first cushioning element, defining a second peripheral side surface aligned with the first peripheral side surface, and including a plurality of openings formed through a thickness of the second cushioning element, the cutout of the first cushioning element mating with a contour of the second cushioning element to define a continuous groove;

a plate disposed between the first cushioning element and the second cushioning element and including a first portion that extends outwardly from the first peripheral side surface and the second peripheral side surface and bisects the continuous groove, a bottom surface of the plate exposed through each of the plurality of openings; and an outsole forming a ground-contacting surface of the sole structure and including a plurality of apertures, each aperture of the plurality of apertures aligned with a respective opening in the plurality of openings and being larger than the respective opening.

12. The sole structure of claim 11, wherein the first portion of the plate extends from the first peripheral side surface and the second peripheral side surface at a mid-foot region of the sole structure.

13. The sole structure of claim 11, wherein the first portion of the plate extends from the first peripheral side surface and the second peripheral side surface at one of a medial side of the sole structure and a lateral side of the sole structure.

14. The sole structure of claim 11, wherein at least one of the first cushioning element or the second cushioning element includes a recess that receives the plate.

15. The sole structure of claim 11, wherein at least one of the first cushioning element and the second cushioning element includes at least one engagement element operable to receive an engagement element of the plate to position the plate relative to the at least one of the first cushioning element and the second cushioning element.

16. The sole structure of claim 11, wherein the plate includes a second portion that extends from the first peripheral side surface and the second peripheral side surface, the second portion being spaced apart and separated from the first portion by an expanse of at least one of the first cushioning element and the second cushioning element.

17. The sole structure of claim 11, wherein the first cushioning element includes a first material having a first durometer and the second cushioning element includes a second material having a second durometer different than the first durometer.

18. The sole structure of claim 11, wherein the second cushioning element includes a heel counter at least partially surrounding the plate.

* * * * *